US005240153A

United States Patent [19]

Tubaki et al.

[11] Patent Number: 5,240,153

[45] Date of Patent: Aug. 31, 1993

[54] LIQUID JET BLOWER

[75] Inventors: Tatsuo Tubaki; Yoshiyuki Kakuta; Takao Kishi, all of Tokyo, Japan

[73] Assignee: Yoshino Kogyosho Co., Ltd., Tokyo, Japan

[21] Appl. No.: 741,416

[22] Filed: Aug. 1, 1991

[30] Foreign Application Priority Data

Dec. 28, 1989 [JP] Japan ..... 1-152460[U]
Dec. 28, 1989 [JP] Japan ..... 1-152462[U]

[51] Int. Cl.[5] ..... B67D 5/40

[52] U.S. Cl. ..... 222/385; 222/396; 222/401

[58] Field of Search ..... 222/401, 635, 636, 637, 222/631, 380, 383, 385, 340, 321, 396

[56] References Cited

U.S. PATENT DOCUMENTS 3,746,261 7/1973 Nozawa et al. ..... 222/340 X
3,777,945 12/1973 Nozawa et al. ..... 222/340 X
3,797,748 3/1974 Nozawa et al. ..... 222/340 X
3,860,150 1/1975 Maier ..... 222/635 X
4,222,500 9/1980 Capra et al. ..... 222/380 X

FOREIGN PATENT DOCUMENTS 57-20024 4/1982 Japan .
28528 8/1985 Japan .
31805 9/1985 Japan .
39095 11/1985 Japan .

*Primary Examiner*—Andres Kashnikow
*Assistant Examiner*—Kenneth DeRosa
*Attorney, Agent, or Firm*—Oliff & Berridge

[57] ABSTRACT

This invention relates to a liquid jet blower that operates as an aerosol sprayer without using any pressurized gas. This invention is intended to provide a liquid jet blower which is free from clogging of the nozzle and undesired flows of the liquid outside its container. To that end, structure is provided for relieving any excessive pressure within its pressure chamber and transferring any remaining liquid to a small chamber specifically arranged within the blower.

4 Claims, 10 Drawing Sheets

LIQUID JET BLOWER

TECHNICAL FIELD

This invention relates to a pressurized liquid jet blower that operates as an aerosol sprayer without using any pressurized gas. The present invention relates not only to a sprayer-type blower but also to a jet blower that discharges its content in the form of liquid or foam without reducing it into fine particles.

BACKGROUND ART

Japanese Patent Disclosure, or Tokkou Shou No. 57-20024 teaches a pressurized liquid jet blower of a type comprising a container, a main tube arranged in the container, a sliding tube arranged within said the tube and a tubular cap fitted to the upper portion of the outer periphery of the tube, wherein the liquid in the container is taken into a pressure chamber by way of liquid intake paths defined by the lower portion of the tube and that of the sliding tube and pressurized in the chamber by rotating the tubular cap to push up the sliding tube against the force applied to it and urging it downward and thereafter the pressurized liquid is blown out of a nozzle in a jet stream by pushing downward an actuator running through the top of said tubular cap and projecting out of it to open a discharge valve disposed at the bottom of the actuator in a valve box that is located below the upper surface of the tubular cap and communicates with the pressure chamber.

While a known pressurized liquid jet blower as described above is advantageous in that the liquid contained in it can be discharged simply by pushing down the actuator with a finger tip as the liquid in the container is partly introduced into the pressure chamber in advance and stored there under pressure, the liquid agent remaining in the discharge path of the actuator can be dried to become solid particles that can eventually clog the discharge path.

Besides, while the known pressurized liquid jet blower is provided with a number of means for preventing the liquid from unintentionally coming out under pressure from the pressure chamber and falling along the outer surface of the blower particularly after the actuator is released, they do not necessarily satisfactorily operate and leave room for improvement.

Particularly, since the above described known pressurized liquid jet blower is so devised that any excessive pressure remaining in the jet blower is relieved through a through bore provided at the top of the tube, some of the liquid in the main tube can come out under pressure through the bore during the operation of relieving the excessive pressure to adhere the inner surface of the barrel of the container above the liquid contained in it. The mechanism of relieving excessive pressure of the blower is not aesthetically recommendable, and, the customer can easily become uncomfortable with the blower once he or she experiences such a trouble with it. Also, since the mechanism of relieving excessive pressure of the blower is arranged independently from its air inlet valve, the tube has a rather complicated configuration.

SUMMARY OF THE INVENTION

It is therefore the object of the present invention to provide an improved liquid jet blower which is free from at least one of the above described problems.

According to a first aspect of the present invention, the above object of the invention is achieved by providing a pressurized liquid jet blower comprising a container, a cylinder (4) projecting downward in the container, a pressure vessel in the form of a tubular plunger fitted within the cylinder and urged downward for suctioning the liquid in the container, the cylinder being constituted by a lower portion of a main tube (2) arranged on said container, an outer tube (40) arranged around and engaged with an upper portion of the main tube (2) designated as upper tube (5), a cam mechanism capable of rotatably raising and lowering an actuator tube provided with the tubular plunger against the biasing force applied to it by rotating the outer tube (40) relative to the main tube (2), a valve assembly (55) having a valve box (56) fitted to the inner surface of the upper tube (5), a discharge pipe (57) projecting downward from the valve box (56) into a pressure chamber in the cylinder (4) through an airtight bore arranged in the tubular plunger and a head (60) standing from the valve box (56), the liquid in the pressure chamber being discharged in a jet stream from a nozzle (59) of the head (60) as the head is pushed downward to open a discharge valve arranged in the valve box, (56) wherein a through bore (10) is formed through the top of cylinder (4), an elastic valve plate (11) being arranged on the top of the cylinder as an anti-negative pressure valve (12) to resiliently close the through bore (10), a first groove (14) and a second sealing ridge (26) being formed respectively on the inner peripheral surface of the cylinder near the lower end thereof and on the outer peripheral surface of the tubular plunger (21) near the lower end thereof to airtightly seal the space between the cylinder (4) and the plunger (21) so that any excessive pressure in the pressure chamber may be relieved out of the container (1) through the space between the inner peripheral surface of the cylinder (4) and the outer peripheral surface of the tubular plunger (21) and the anti-negative pressure valve (12) when second sealing ridge (26) is received in the first groove (14).

A liquid jet blower according to the first aspect of the invention and having a configuration as described above may additionally comprise a first sealing ridge (13) formed on the inner peripheral surface of the upper tube (5) near the lower end thereof to airtightly contact with the outer surface of the tubular plunder (21) and a second groove (27) formed on the outer peripheral surface of the plunger (21) near the lower end thereof so that ambient air may flow into the container (1) through the second groove (27) and the anti-negative pressure valve (12) when the tubular plunger is brought to its uppermost position.

A liquid jet blower according to the first aspect of the invention may additionally comprise a third groove formed on the outer peripheral surface of the tubular plunger (21) near the upper end thereof and a bored elastic disc (29) arranged around the third groove with its inner periphery fitted into the third groove and its outer periphery abutting the inner peripheral surface of the upper tube (5), the air contained in the space defined by the bored elastic disc (29), the inner surface of the upper tube (5) below the bored elastic disc and the outer surface of the tubular plunger (21) functioning as an air cushion having an air outlet when the tubular plunger is urged downward.

A liquid jet blower according to the first aspect of the invention may be advantageously so configured that the outer tube (40) is constituted by an inner tubular member (40*a*) comprising first and second engaging tubes (41) and (42) projecting downward respectively from the outer periphery and the inner periphery of the bored top of the inner tubular member (40*a*) and an outer tubular member (40*b*) having a lower tubular portion fitted to the outer surface of the inner tubular member, a second flange (43) formed on the inner peripheral wall of the first engaging tube (41) near the lower end thereof and rotatively abutting the lower surface of a first flange (8) formed on the outer peripheral surface of the upper tube (5) near the upper end thereof and a second group of longitudinal grooves and ridges (44) being formed on the outer peripheral surface of the second engaging tube (42), the second longitudinal grooves and ridges (44) being engaged with a first group of longitudinal grooves and ridges (24) formed on the inner peripheral surface of a cam cylinder (23) standing upward from the top of the tubular plunger (21) so that the second engaging cylinder (42) and the cam cylinder (23) may be longitudinally slidable relative to each other.

As seen from FIG. 1, when the tubular plunger (21) is urged downward to its lowest position where the second sealing ridge (26) arranged on the outer peripheral surface of the tubular plunger (21) near the lower end thereof is received in the first groove (24) arranged on the inner peripheral surface of the cylinder (4) near the lower end thereof, any excessive pressure existing in the pressure chamber of the cylinder is relieved out of the container (1) through the space defined by the first groove (14), the inner peripheral surface of the cylinder and the outer peripheral surface of the tubular plunger, and the anti-negative pressure valve (12).

As seen from FIG. 2, when the actuator cylinder (20) having the tubular plunger (21) is raised to its uppermost position by the cam mechanism, the portion of the first sealing ridge (26) located above the through bore (10) goes into the second groove (27) on the outer peripheral surface of the tubular plunger (21) near the lower end thereof so that the anti-negative pressure valve (12) may be opened to allow ambient air to flow into the container (1) to compensate the negative pressure existing, if any, in the container.

When the container (1) has no liquid in it and an actuator cylinder (20) is lowered, it might seem that the actuator cylinder moves downward very fast as it is urged by a spring (50) and is not resisted by the inner pressure. However, as seen from FIG. 5, since the elastic disc (29) is also lowered with its outer periphery kept in contact with the inner peripheral surface of the upper tube (5) of the main tube (2), the air contained in the space defined by the bored elastic disc, the inner surface of the upper tube below the bored elastic disc and the outer surface of the tubular plunger (21) functions as a shock absorber and the air is only gradually let out of the space through a notch (30) formed on the outer periphery of the elastic disc so that the actuator cylinder (20) goes down only slowly and would not fall with a crash.

Since the outer tubular member (40) has no component which is screwed into the upper tube (5), any of the components of the outer tubular member would not be made loose by the rotary movement of the outer tubular member which is an action necessary to operate the cam mechanism, and the outer tubular member (40) can rotate surely.

According to a second aspect of the present invention, there is provided a liquid jet blower having an aerosol type injection valve comprising a valve box (101) having an opening at the bottom in communication with a source of pressurized liquid located below it, an upper opening provided with a circumferential annular gasket (104) at the top and a table (106) surrounded by an elastic peripheral wall (105) at the center, a injection pipe (102) having a thinned pipe portion with a small diameter (107) running through a gasket (104) of the valve box (101) and projecting outward from the gasket and an enlarged lower pipe portion with a large diameter (108) having its bottom abutting the elastic peripheral wall (105), the injection pipe (102) being biased upward by a pusher spring (109) by way of the enlarged pipe portion (108) so that a communicating hole (110) bored through its side wall is blocked by a gasket (104) and a small chamber (111) is formed between the enlarged pipe portion (108) and the table (106) for receiving any remaining liquid, and an injection button (103) having a nozzle (112) connected to and communicating with the upper portion of the injection pipe (102).

In the aerosol type injection valve of a liquid jet blower as described above, the combined injection pipe (102) and injection button (103) are constantly urged upward by pusher spring (109) so that the communicating hole (110) is blocked by gasket (104) and the enlarged portion (108) of the injection pipe (102) is lifted from the upper surface of the table (106) to form a small chamber (111) between the enlarged portion (108) and the table (106) as illustrated in the left half area of FIG. 8.

When the injection pipe (102) is pushed down by way of the injection button (103) against the resilient force of the spring (109) to blow out the liquid in the jet blower as illustrated in the right half of FIG. 8, the gasket (104) is moved away from the communicating hole (110), which then becomes in communication with the valve box (101) so that the injection pipe (102) provides a through path between the injection button (103) and the inside of the valve box (101) and therefore the source of pressurized liquid located below the valve box (101) and consequently the liquid is blown out of the nozzle (112) under pressure so far as the injection button (103) is held down.

When the injection button (103) is released from the lowered position to stop the jet blowing of liquid, the injection pipe (102) may contain some liquid between the injection button (103) and the nozzle (112). The remaining liquid, however, is attracted into the small chamber (111) which is formed as the injection pipe (102) is pushed back to its original position by the pusher spring (109). Therefore, the level of the remaining liquid is lowered and no liquid is found around the nozzle (112) so that it is free from any clogging that can be caused by the solid substance produced as the liquid is evaporated in the injection pipe (102).

According to a third aspect of the invention, there is provided a liquid jet blower comprising a container (201), a main tube (202) arranged in the container, a tubular cap (220), a sliding tube (210) to be vertically and slidingly moved by rotating the tubular cap (220), the tubular cap (220) and the sliding tube (210) being urged downward and fit into the main tube (202), a pressure chamber (219) having a liquid suction path and defined by a first cylinder constituted by a lower portion of the main tube (202) and a lower portion of the sliding tube, a valve box rigidly fitted to the inside of an upper portion of the tubular cap (220), the pressure chamber (219) and the valve box being kept in communication with each other, and an actuator (245) projecting upward from the valve box through the top of the tubular cap (220), the liquid in the pressure chamber (219) being blown out of a nozzle arranged in the actuator (245) by pushing down the actuator (245), wherein it further comprises a pipe member (240) whose upper edge is fitted into a groove (233) formed on the periphery of the lower surface of a top wall (232) of the tubular cap (220) in such a manner that a pipe section (242) projecting downward from the inwardly flanged bottom of a second cylinder (241) formed by the upper portion of the pipe member (240) and used for the valve box provides a path for communicating the inside of the second cylinder (241) and the pressure chamber (219), a third cylinder (246) which is loosely fitted in the second cylinder (241) below the actuator (245) and provided with a stem (247) standing upward therefrom by way of a shoulder section, a push-down head (248) which is provided with a nozzle and an inner tube (249) and arranged around the stem (247) in such a manner that the inner tube is tightly fitted to the outer surface of the upper portion of the stem and the head itself is urged upward, a tubular valve body (251) which is airtightly arranged around the outer peripheral surface of the stem between the third cylinder (246) and the inner tube (249) in such a manner that it is held between the shoulder section and the lower surface of the top of the tubular cap and can be slidingly moved downward when pushed by the lower end of the inner tube (249) and upward when pushed by the upper end of the shoulder section and its outer peripheral surface is in close contact with the inner peripheral surface of the second cylinder, a piston member (257) which is provided with a rod section (256) having a conduit (255) and projecting downward into the pipe section (242) and fitted into the third cylinder (246), and a discharge valve hole (250) arranged at the bottom of the stem.

When the tubular cap (220) of a liquid jet blower having a configuration as described is rotated relative to the main tube (202), the balls (217) are pressed downward and moved from the upper end of the vertical groove section (215) into the inclined groove section (214) of the respective cam grooves (216) so that the sliding tube (210) is pulled up relative to the main tube (202) and consequently the volume of the pressure chamber (219) is increased to open the suction valve (203) and attract the liquid in the container into the pressure chamber. At this stage, since the balls (217) are located at the bottom of the vertical groove section (215) of the respective cam grooves and the sliding tube (210) is pushed by the first spring (225) and moved downward, additional pressure is applied to the liquid in the pressure chamber. If the push-down head (248) is depressed under this condition, the actuator (245) is firstly lowered leaving the tubular valve (251) in position and thereafter the tubular valve (251) is moved downward as it is pushed by the lower end of the inner tube (249) of the push-down head (248) as seen from the left half of FIG. 12. As the actuator (245) is lowered, the discharge valve hole (250) located at the lower end of the stem (247) becomes open so that the pressurized liquid is blown out from the nozzle by way of the pipe section (242), the conduit (255) and the space between the second cylinder (241) and the third cylinder (246). When the push-down head (248) is released, the second compression spring (258) is pressed downward as illustrated in the right half of FIG. 12 to raise the actuator (245) so that the upper surface of its shoulder section comes to abut the tubular piston and close the discharge valve hole (250). As the actuator is raised further, tubular valve (251) comes to abut the lower surface of the top of the tubular cap (220) where it stops its movement. As the actuator is kept on moving at least for a while after the closure of the discharge valve hole (250), the volume of the third cylinder (246) located above the piston (257) is increased to generate a negative inner pressure that takes up the liquid left within the nozzle.

According to a fourth aspect of the invention, there is provided a pressurized liquid jet blower comprising a container (301), a main tube (302) arranged in the container, a tubular cap (320) arranged on the top of the main tube, a sliding tube (310) to be vertically and slidingly moved by rotating the tubular cap (320), the tubular cap (320) and the sliding tube (310) being urged downward and fit into the main tube (302), a pressure chamber (319) having a liquid suction path and defined by a first cylinder (304) constituted by a lower portion of the main tube (302) and a tubular plunger (311) constituted by a lower portion of the tubular cap (320), a valve box rigidly fitted to the inside of an upper portion of the tubular cap (320), a pressure chamber (319) and said valve box being kept in communication with each other, and an actuator (345) projecting upward from the valve box through the top of the tubular cap (320), the liquid in said pressure chamber (319) being blown out of a nozzle arranged in said actuator (345) by pushing down said actuator (345), the inside of the pressure chamber and that of the container becoming in communication with each other by way of a through bore formed through an upper portion of the cylinder wall when the tubular plunger reaches the lower end of the first cylinder, wherein the main tube (302) is provided with an outward flange (305*a*) arranged at the top of a plurality of connector plates (360) arranged regularly around the outer surface of the upper portion of the first cylinder and spaced apart from the outer surface of the upper portion, an upper tubular section (305) standing upward from the outer periphery of the outward flange and a valve tube (362) having a elastic tube section (363) projecting downward from the lower surface of a bored disc (365) with its outer periphery rigidly fitted to the upper surface of the outward flange and its inner periphery airtightly fitted to the outer peripheral surface of the tubular plunger (311), the elastic tube section being inserted into the space between the outer surface of the upper portion and the connector plates in such a manner that the inner periphery of the lower end of the elastic tube section is closely fitted to the outer peripheral surface of the cylinder to form an ambient air inlet valve (364), an axial groove (361) being formed along the upper portion of the cylinder so that it can replace the through bore, a recess (367) being formed on the outer surface of the tubular plunger (311) for releasing the airtight connection between the inner periphery of the bored disc and the outer peripheral surface of the tubular plunger when the tubular plunger reaches its uppermost position.

When the tubular cap (320) of a pressurized liquid jet blower having a configuration as described above is rotated relative to the main tube (302) from the condition as illustrated in FIG. 15, the balls (317) are pushed downward and moved from the vertical groove section (315) of the respective cam grooves (316) into an inclined groove section as illustrated in FIG. 17 and therefore the sliding tube (310) is pushed up relative to the main tube (302) is shown in FIG. 16 so that the pressure chamber (319) is expanded to open the suction valve (303) and take the liquid in the container into the pressure chamber. Since the balls (317) are located at the lower end of the inclined groove section (315) of the cam grooves and the sliding tube (310) is pushed downward by the first spring (325) at this stage, additional pressure is applied to the liquid in the pressure chamber. If the push-down head (348) is depressed under this condition, first the actuator (345) is lowered to open the discharge valve hole (350), leaving the tubular valve (351) behind and making the liquid in the pressure chamber burst out from the nozzle and then, if the push-down head is depressed further, the tubular valve (351) is lowered by the inner tube (349) of the actuator. When the actuator is released, the actuator is raised by the resilient force of the second compression spring (358) until its shoulder comes to abut the tubular valve (351) and close the discharge valve hole (350). Thereafter, the tubular valve (351) follows the actuator to return the entire system to the original condition.

When the sliding tube (310) is pushed up to its uppermost position, the recess (367) on the outer surface of the tubular plunger (311) formed by its lower portion comes to a position located inside the bore of the disc (365) of the valve tube (362) rigidly fitted to the upper end of the first cylinder (304) so that the ambient air that has passed through the axial groove (361) at the upper end of the first cylinder to expand the elastic tube (363) goes into the container to compensate the negative pressure of the container caused by the decrease of the volume of the liquid in it. When the tubular plunger (311) reaches the lowermost position as shown in FIG. 15, the air passes through the groove (367) on the inner surface of the lower end of the first cylinder and the space between the tubular plunger and the first cylinder to expand the elastic tube (363) further so that any excessive pressure in the first cylinder (304) may be relieved out of the container.

Now the present invention will be described in greater detail by referring to the accompanying drawings that illustrate preferred embodiments of the invention.

BRIEF DESCRIPTION OF THE DRAWINGS

Of FIGS. 1 through 7 illustrating a preferred embodiment of the first aspect of the invention.

Figure 8:
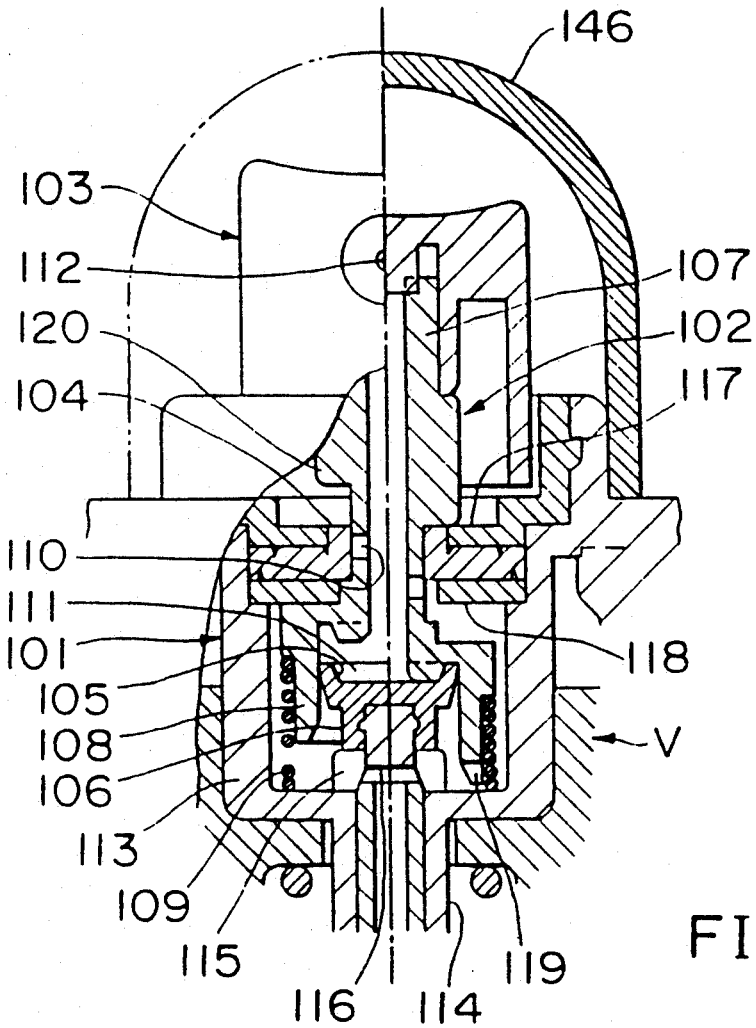
Figure 9:
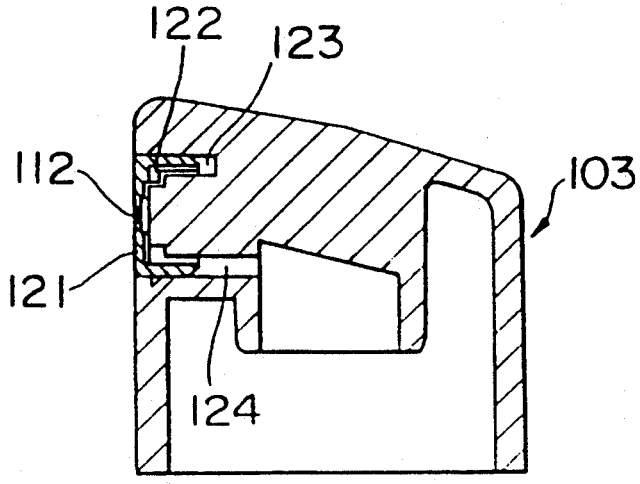
Figure 10:
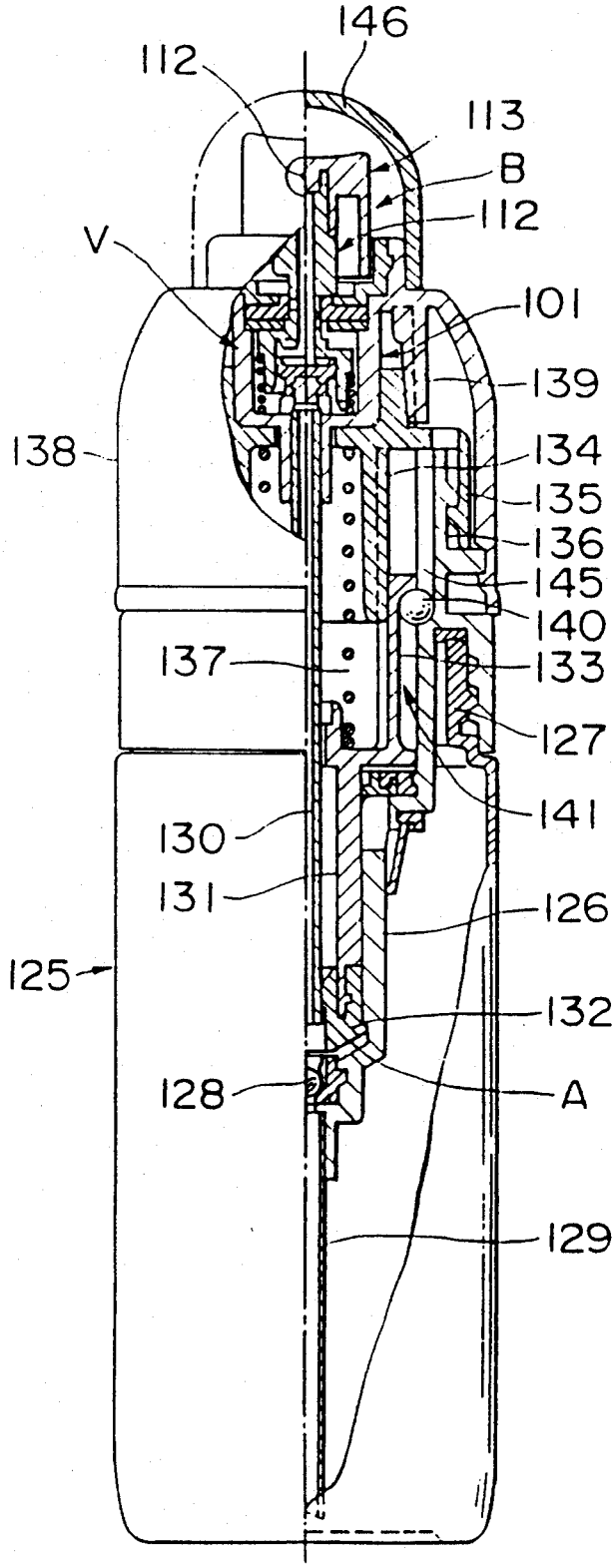
Figure 11:
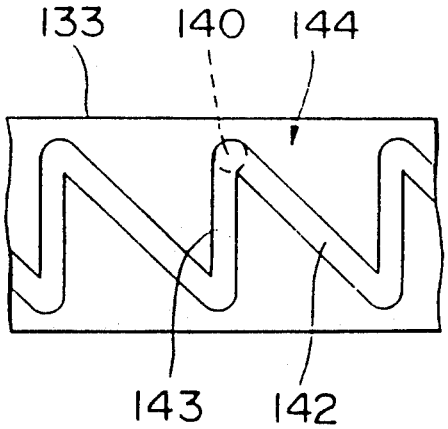

Of FIGS. 8 through 11 illustrating a preferred embodiment of the second aspect of the invention;

FIG. 8 is a longitudinal sectional view of the embodiment showing in the left half a condition where it is not used and in the right half a condition where it is used for blowing the liquid contained in it, FIG. 9 is a longitudinal sectional view of the injection button of the injection valve of the embodiment, FIG. 10 is a side view of the embodiment showing its principal area partly torn off and FIG. 11 is an unfolded schematic view of the cam groove of the embodiment.

Figure 12:
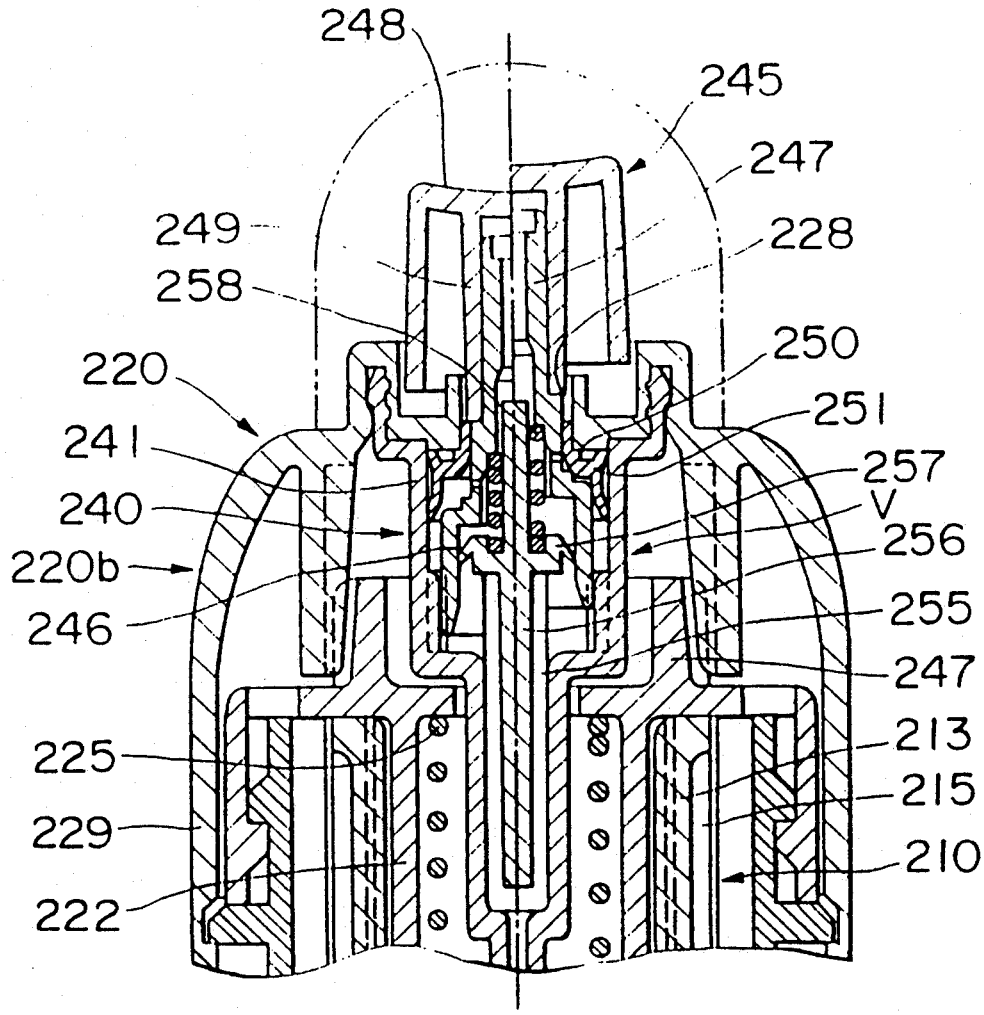
Figure 13:
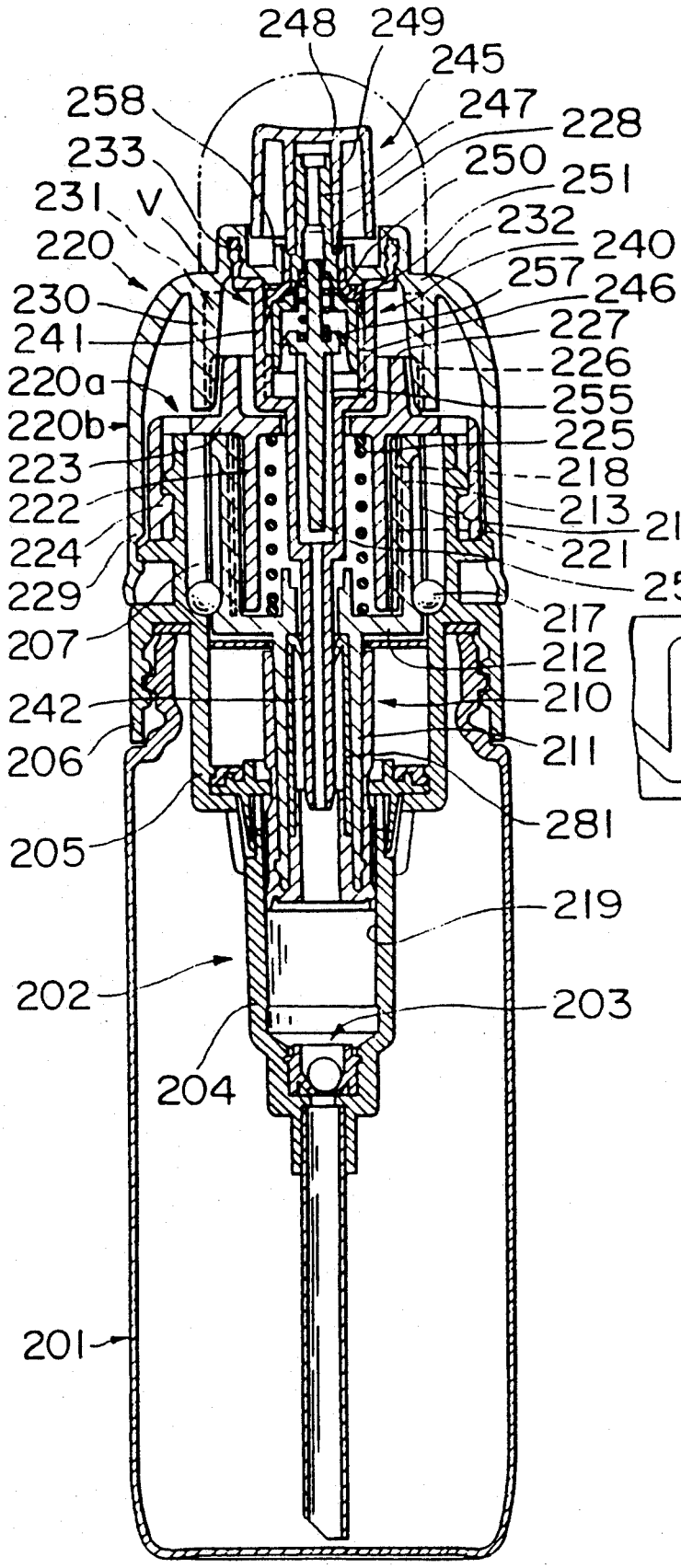
Figure 14:
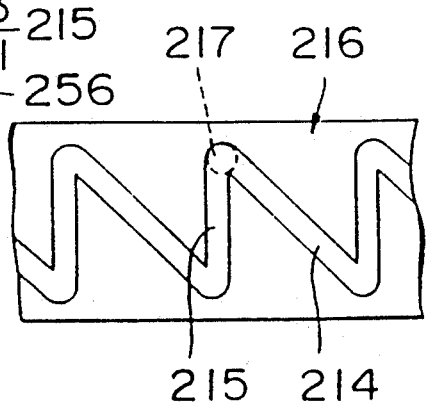

Of FIGS. 12 through 14 illustrating a preferred embodiment of the third aspect of the invention;

FIG. 12 is a sectional view of a principal area of the embodiment showing in the right half a condition where the actuator is being raised and in the left half a condition where the actuator is being lowered, FIG. 13 is a sectional view showing a condition where the sliding tube is being raised and FIG. 14 is an unfolded schematic view of the cam groove.

Figure 15:
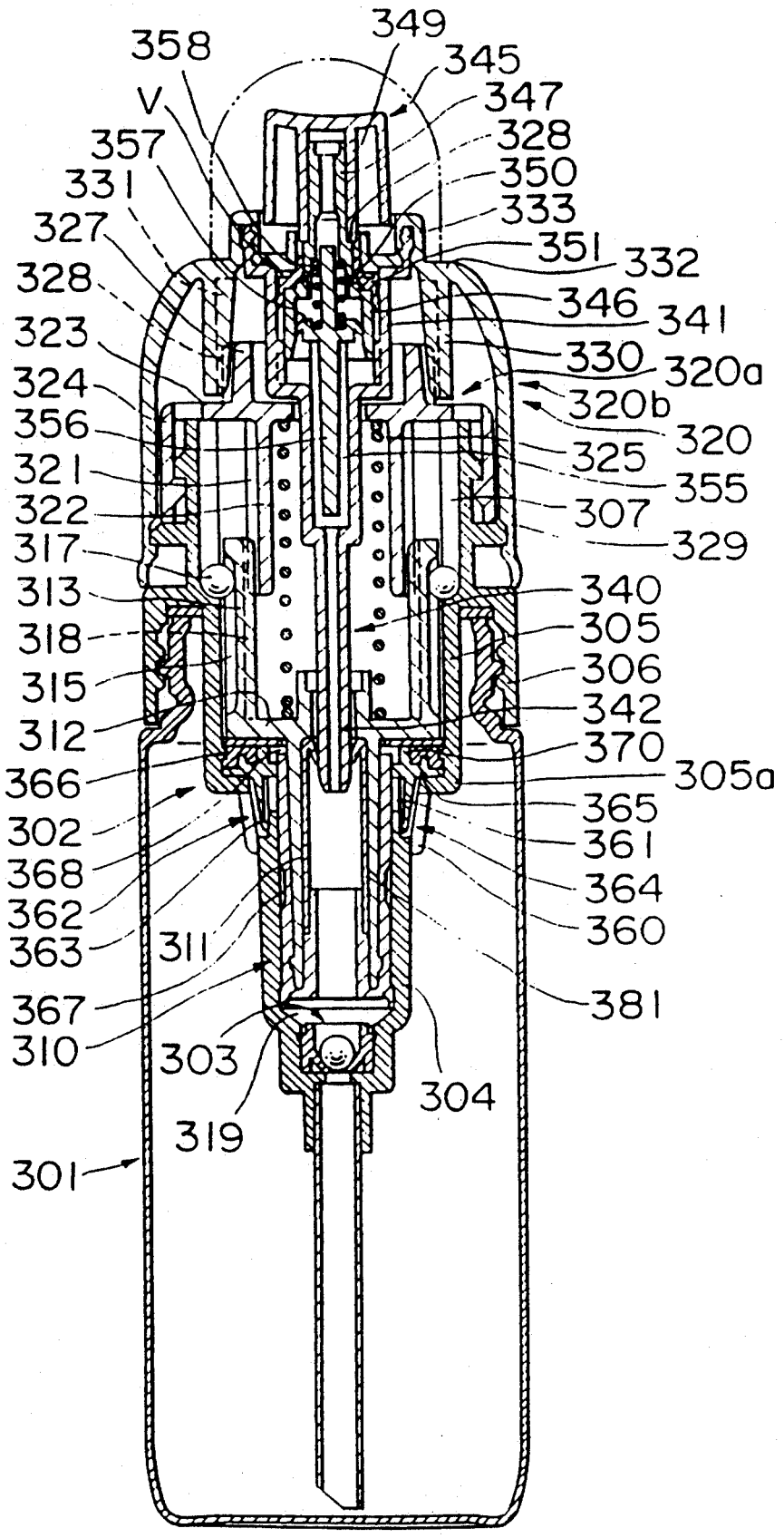
Figure 16:
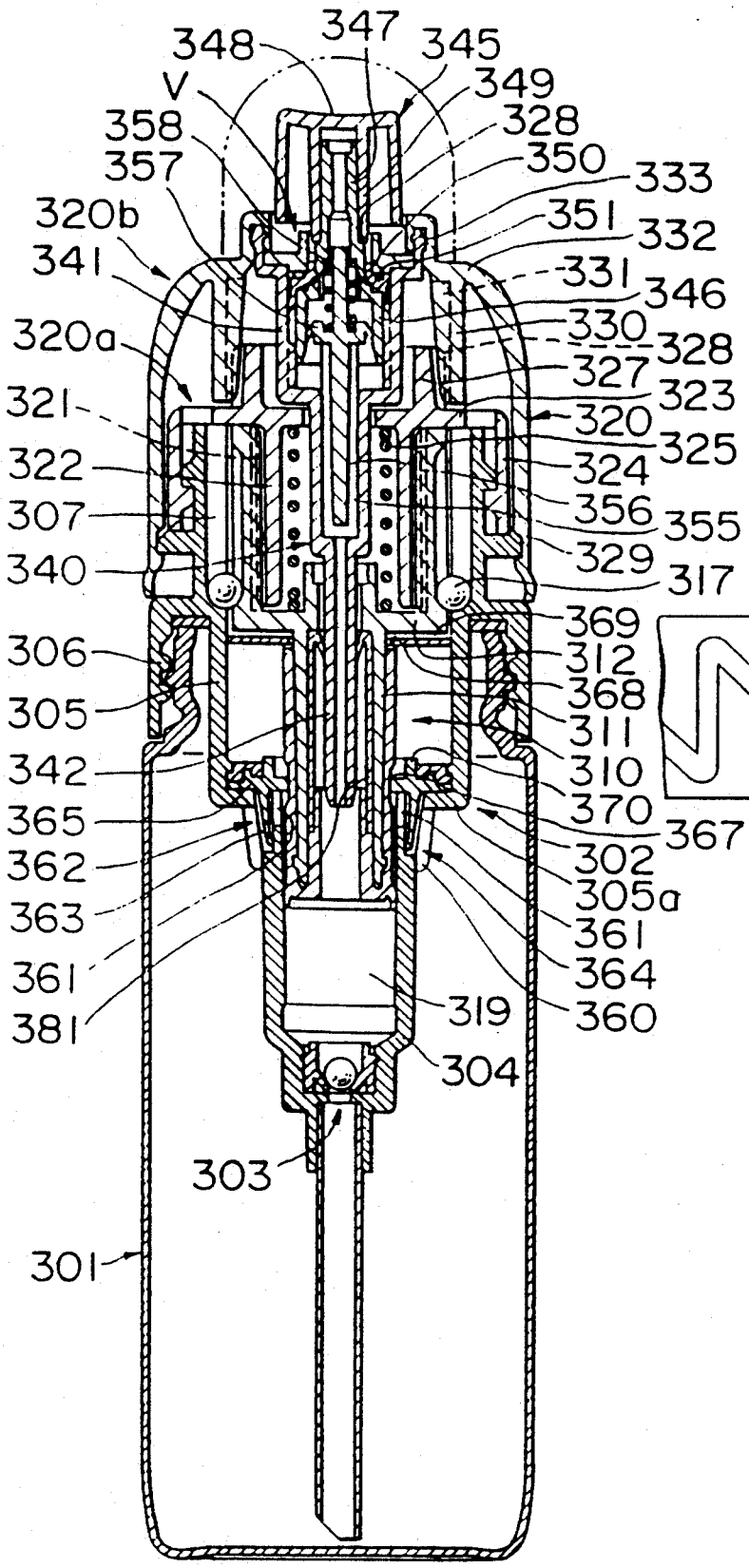
Figure 17:
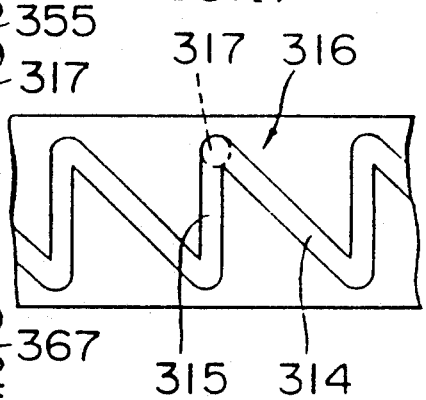

Of FIGS. 15 through 17 illustrating a preferred embodiment of the fourth aspect of the invention;

FIG. 15 is a sectional view of the embodiment showing a condition where the sliding tube is set to its lowermost position, FIG. 16 is a sectional view similar to FIG. 16 showing a condition where the sliding tube is set to its uppermost position and FIG. 17 is an unfolded schematic view of the cam groove.

BEST MODE FOR CARRYING OUT THE INVENTION

Embodiment 1

Now a preferred embodiment according to the first aspect of the invention will be described by referring to FIGS. 1 through 7.

Reference numeral 1 denotes a container and reference numeral 2 denotes a main tube having a cylinder 4 projecting downward and provided at its lower end with a suction valve 3. An upper tube 5 is standing upward from an outward flange arranged on the upper end of the cylinder. A threaded tube 6 which is fitted to the neck portion of the liquid jet blower is suspending from the middle of the upper tube with the outward flange interposed therebetween. A large engaging disc 7 is arranged slightly above the threaded tube 6 and a number of first engaging ridges 8 are circularly arranged thereabove, while a number of longitudinal grooves 9 are arranged on the inner peripheral surface of the upper portion of the upper tube and spaced apart regularly from adjacent ones.

A through bore 10 is formed through the top of the cylinder 4 and resiliently closed at its top by an elastic valve plate 11, through bore 10 and elastic valve plate 11 constituting an anti-negative pressure valve 12. The bottom of the upper tube located above the through bore is provided along the peripheral area of its inner surface with a first sealing ridge 13 which, when covered by a rubber packing ring, comes to airtightly contact with the outer peripheral surface of a tubular plunger, which will be described later, whereas the bottom of the cylinder is provided along the periphery area of its inner surface with a first groove 14. The first groove may be alternatively arranged on the outer peripheral surface of the lower portion of the cylinder. Still alternatively, the groove may be replaced by a number of grooves spaced apart from adjacent ones. A suction pipe 15 projects downward from the bottom of the cylinder.

Reference numeral 20 denotes an actuator tube provided at its lower portion with a tubular plunger 21. A cam tube 23 is standing from the tubular plunger by way of an outward flange arranged on the upper end of the plunger and provided with cam grooves 22 each including an inclined groove section 22*a* and a vertical groove section 22*b*, which is continuously extended from the inclined groove section as seen from FIG. 3. The cam tube is provided on its inner surface with a first group of longitudinal grooves and ridges 24.

Figure 1:
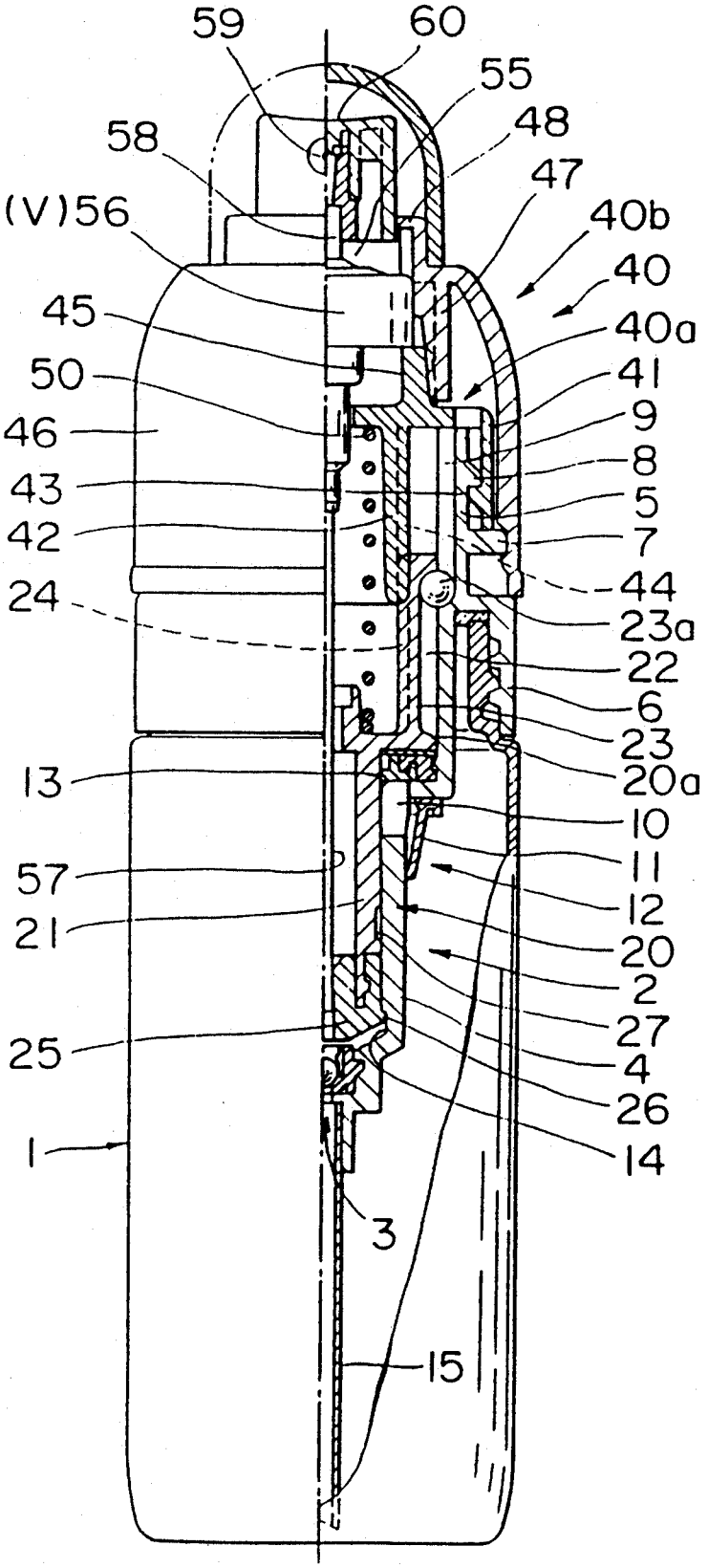
FIG. 1 is a half sectional view of the embodiment.
Figure 2:
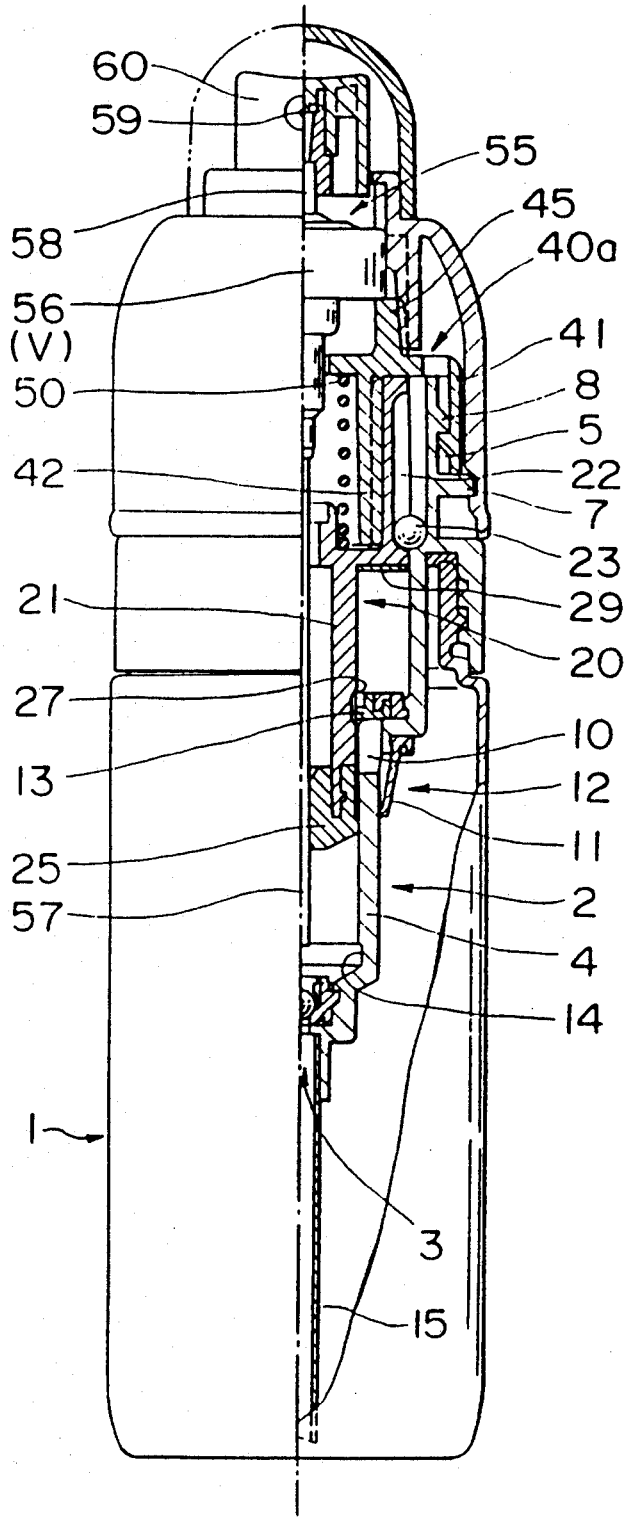
FIG. 2 is a half sectional view of the embodiment showing a condition where the actuator tube is set to an upper position.

The upper half of a ball 23*a* is fitted into the lower end of each of the longitudinal grooves 9, while the lower half of the ball 23*a* is fitted into the corresponding one of the cam grooves 22. A plunger ring 25 carries on its O-shaped bottom plate an inner tube and an outer tube respectively standing upward from its inner periphery and its outer periphery and is fitted into the lower end of the tubular plunger 21, which lower end is provided with a second sealing ridge 26 arranged therearound. The tubular plunger and the cylinder are so designed that the outer peripheral surface of the former and the inner peripheral surface of the latter are slightly spaced apart from each other while the outer periphery of the second sealing ridge airtightly contacts with the inner peripheral surface of the cylinder. It should be noted that, when the second sealing ridge 26 is placed within the first groove 14 as illustrated in FIG. 1, the pressure chamber of the cylinder and the through bore 10 are in communication with each other by way of the first groove 14 and the small space between the tubular plunger and the cylinder as described above so that any excessive pressure in the pressure chamber may be relieved out of the container 1 by way of the anti-negative pressure valve 12. It should also be noted that the tubular plunger 21 is provided on the outer peripheral surface of its lower portion with a second groove 27 so that, when the tubular plunger is raised until the first sealing ridge 13 is received by the second groove 27, ambient air may enter the container by way of the space between the cam tube 23 and the upper tube 5, the second groove 27 and the anti-negative pressure valve 12.

Cylinder 4 and the tubular plunger 21 constitute a pressure device to be used for sucking liquid.

Figure 5:
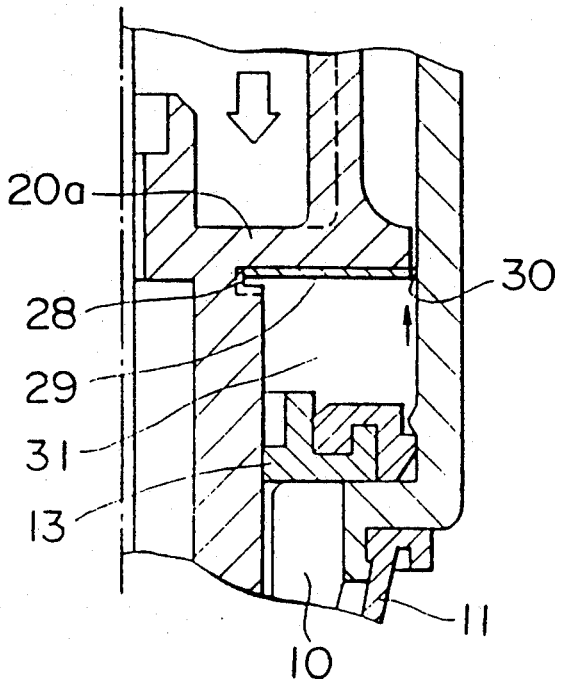
FIG. 5 is a sectional view of a part of the embodiment showing a condition where the elastic disc is being lowered.
Figure 6:
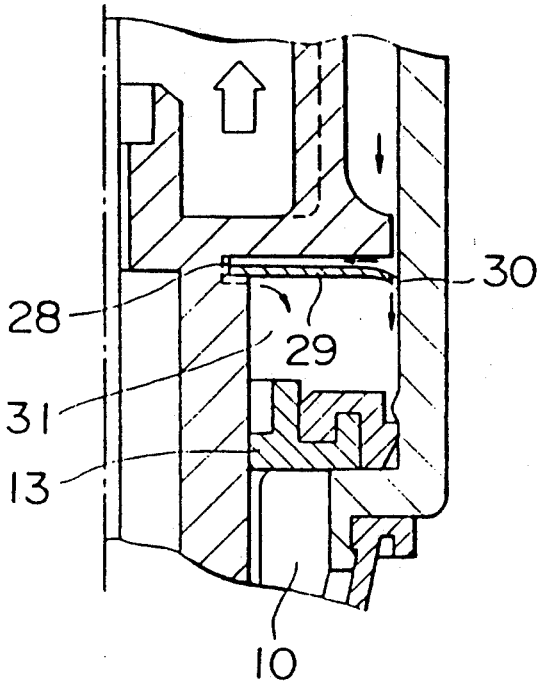
FIG. 6 is a sectional view similar to FIG. 5 showing a condition where the elastic disc is being raised and FIG. 7 is a sectional view similar to FIG. 5 showing a condition where the elastic disc is set to its lowermost position.
Figure 7:
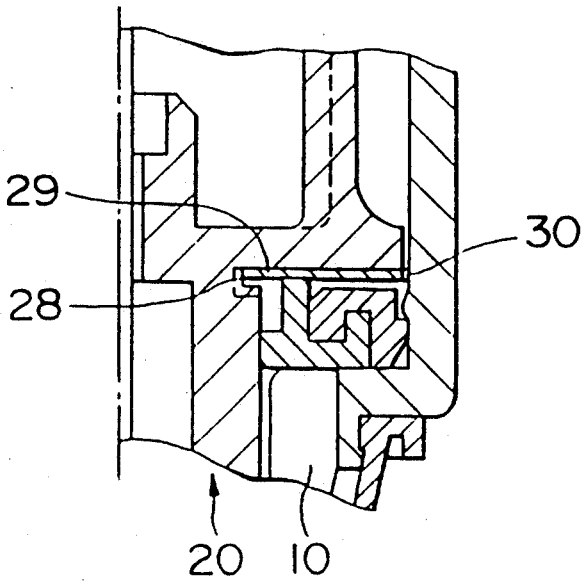

As shown in FIGS. 5 through 7, tubular plunger 21 is provided on the outer peripheral surface of its upper portion with a third groove 28, which receives the inner periphery of a bored elastic disc 29 in such a manner that bored elastic disc 29 is vertically movable within the groove and its outer periphery contacts with the inner surface of the upper tube 5. Bore elastic disc 29 is also provided with a notch 30 at an outer periphery and a continuous small groove is formed on an upright wall section and a lower flat wall section of the third groove.

Elastic disc 29 is so arranged that its upper surface is kept in contact with the lower surface of the outward flange 20*a* except the outer periphery of the elastic disc when the actuator tube 20 is being lowered and therefore the air contained in a space defined by the elastic disc 29, the inner surface of the upper tube 5 located below the disc 29 and the outer surface of the tubular plunger 21 provides an air cushion having an air outlet when the tubular plunger is lowered. The air outlet is defined by notch 30 and the small groove.

Outer tube 40 is rotatively fitted to the outer periphery of the upper portion of upper tube 5. The outer tube is constituted by an inner tubular member and an outer tubular member. Inner tubular member 40*a* comprises a first engaging tube 41 and a second engaging tube 42 projecting downward respectively from the outer periphery and the inner periphery of its top having the shape of a bored disc. The first engaging tube has on its inner peripheral wall a second circumferential ridge 43 which abuts the lower surface of the first circumferential ridge 8 arranged on the outer peripheral wall of the upper tube. The second engaging tube has on its outer peripheral surface a second group of vertical grooves and ridges 44, which are engaged with the first group of vertical grooves and ridges 24 arranged on the inner surface of the cam tube 23 so that the second engaging tube and the cam tube may not rotate relative to each other. The outer tube further comprises a third engaging tube 45 standing upright from the upper surface of its bored disc-shaped top. Third engaging tube 45 is engaged with the outer tubular member and has a group of vertical grooves arranged on its outer peripheral wall. Outer tubular member 40*b* has on its inner peripheral surface a circumferential groove that rotatively receives the outer periphery of the engaging disc 7. The top of the outer tubular member 40*b* is rounded. A fourth engaging tube 47 is suspending from the inner periphery of the top in such a manner that its lower portion is fitted to the outer peripheral surface of third engaging tube 45, while a fifth engaging tube having a plurality of ribs arranged on its inner peripheral surface is standing upward from the top of the outer tubular member in such a manner that the outer periphery of the valve box 56 of a valve assembly, which is described later, is held between the lower ends of the ribs and the top of the third engaging tube 45.

A spring 50 is disposed between the lower surface of the bored disc-shaped top of inner tubular member 40*a* and the upper surface of the outward flange 20*a* of the actuator tube 20 so that the actuator tube 20 is constantly urged downward.

Figure 18:
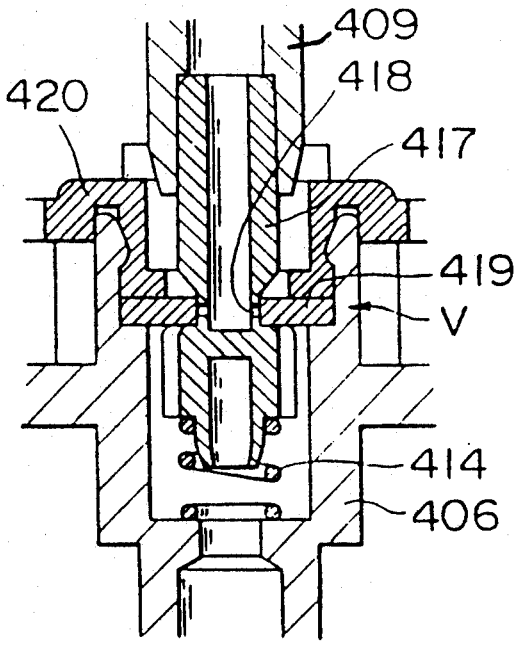
Figure 19:
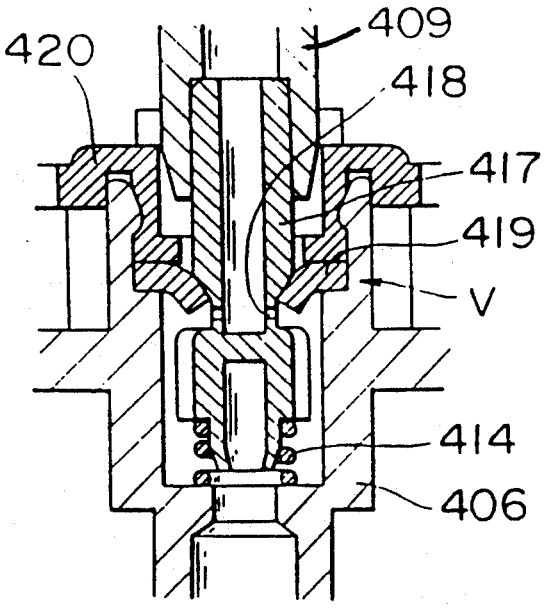

The valve assembly 55 comprises, besides valve box 56, a discharge pipe 57 projecting downward from valve box 56 and airtightly connecting the valve box and the pressure chamber in the cylinder through the tubular plunger 21, a stem 58 standing upward from the valve box 56 and a head 60 having a nozzle 59 and fitted to the top of the stem 58. The discharge valve of the valve box 56 may have a configuration as shown in FIG. 18 or FIG. 19. When the head 60 is depressed while the inside of the pressure chamber is under pressure, the stem 58 is lowered into the valve box to open the discharge valve in the valve box so that the liquid in the pressure chamber is blown out of the nozzle 59 under pressure.

Figure 3:
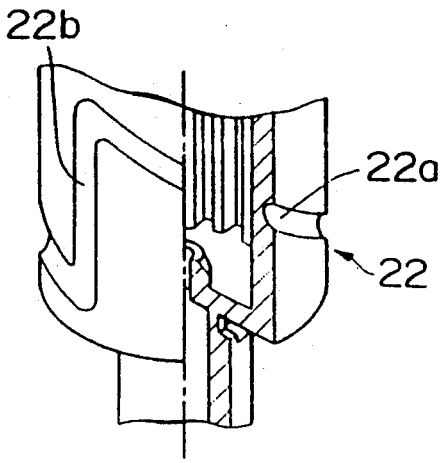
FIG. 3 is a perspective view of a principal area of the actuator partly torn off.
Figure 4:
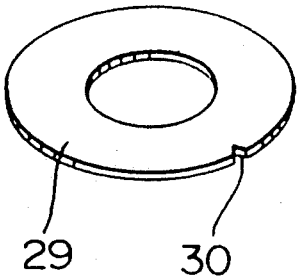
FIG. 4 is a perspective view of the elastic disc.

In order to take liquid into the pressure chamber, the outer tube 40 is rotated clockwise relative to the container 1 so that the actuator tube 20 is raised by the cam mechanism against the biasing force applied to it to reduce the pressure of the inside of the pressure chamber under negative pressure and let the liquid goes into the container through the suction pipe 15 and the suction valve 3. Under this condition, the balls 23*a* move to the lower ends of the respective inclined groove sections 22*a* of the cam grooves 22, which correspond to the related vertical groove sections 22*b* as illustrated in FIG. 3. Thus, since the actuator tube 20 is lowered gradually as a function of the decrease of the volume of the liquid in the pressure chamber caused by liquid injection, the liquid in the pressure chamber is kept constantly under high pressure so that it may blow out each time the discharge valve is opened. While it may seem that the liquid loses its energy to blow out because of the reduction of pressure in the pressure chamber when the actuator is lowered close to its lowest position, such a condition is prevented from occurring by the second sealing ridge 26 located in the second groove 14 that moves any remaining pressure into the container and, therefore, the discharge of liquid immediately stops. The negative pressure in the pressure chamber caused by the reduction of the volume of the liquid there is compensated by the ambient air that comes into the chamber through the space between the outer peripheral surface of the actuator tube above the second groove and the inner peripheral surface of the main tube, the second groove and the negative pressure rod valve 12 as the actuator is raised and the second groove 27 is moved toward the inside of the first sealing ridge 13.

With the embodiment having a configuration as described above, where an anti-negative pressure valve 12 and a first groove 14 are arranged respectively on the top of the cylinder and on the inner peripheral surface near the bottom of the cylinder and a second sealing ridge 26 is arranged at the bottom of the tubular plunger 21 so that any pressure remaining in the pressure chamber is relieved out of the container through the first groove, the space between the inner peripheral wall of the cylinder and the tubular plunger and the anti-negative pressure valve 12 once the second sealing ridge 26 is placed in the first groove 14, no liquid will accidentally flow out of the container after use and the discharge pipe 57 does not need to be taken out of the plunger ring 25 fitted to the bottom of the tubular plunger as in the case of a known liquid jet blower, which makes the inner surface of the plunger ring free from damage and defective sealing due to friction and collision between the bottom of the discharge pipe and the inner surface of the plunger that may occur each time when the discharge pipe is taken out of the plunger ring. As described later, if a first sealing ridge 13 is arranged on the inner surface and near the bottom of the upper tube 5 above the through bore 10 in such a manner that it airtightly contacts the outer surface of the tubular plunger and a second groove 27 is arranged on the outer surface near the bottom of the tubular plunger in such a manner that ambient air is allowed to enter the container 1 by way of the second groove 27 and the anti-negative pressure valve 12 when the tubular plunger 21 is brought to its uppermost position, the overall anti-negative pressure mechanism of the container can be simplified without degrading its function and, at the same time, it may be used for both prevention of negative pressure and relief of the remaining pressure. Furthermore, if a third groove 28 is horizontally arranged on the outer peripheral surface of the upper portion of the tubular plunger to receive the inner peripheral edge of a bored elastic disc 29, whose outer peripheral edge is brought to contact with the inner surface of the upper tube to form an air cushion having an air outlet and defined by the inner surface of the upper tube 5 located below the bored elastic disc and the outer surface of the tubular plunger, any fall of the main tube 2 to be effected when no liquid is introduced into the pressure chamber will take place without crash noise.

Finally, if the outer tube 40 is constituted by an inner tubular member 40*a* and an outer tubular member 40*b* fitted to the inner tubular member and having a second groove 43 horizontally arranged on the inner peripheral surface and near the bottom of the first engaging tube 41 of the inner tubular member and rotatively engaged with the lower surface of the first groove 8 of the upper tube 5, while the second group of grooves and ridges 44 vertically arranged on the outer surface of the second engaging tube 42 of the inner tubular member are respectively engaged with the second group of grooves and ridges 24 of the cam tube 23 standing from the top of the cylinder in such a manner that the second engaging tube 42 and the cam tube are vertically slidable relative to each other, the engagement of the cam tube and the outer tube will not become loose unlike the case where the cam tube is screwed to a part of the outer tube and therefore liable to be unscrewed from the latter and the outer periphery of the valve box 56 of the valve assembly may be held between the top of the inner tubular member 40*a* and the inner surface of the upper portion of the outer tubular member 40*b* to simplify the overall configuration of the valve assembly.

Embodiment 2

Now a second embodiment of the invention will be described by referring to FIGS. 8 through 11. FIG. 8 shows the arrangement, in cross section, of the aerosol type injection valve and the related components of the second embodiment. The injection valve comprises a valve box 101, an injection pipe 102 and an injection button 103.

The valve box 101 has a cup-shaped box body 113 and a connector pipe 114 arranged through the center of the bottom of the box body to connect the valve box and the liquid intake and pressure system (not shown) of the jet blower main body and keep them in communication with each other. A number of legs 115 which are regularly spaced apart from adjoining ones in the box body 113 are standing respectively on bores arranged around the opening for the connector pipe to support a pedestal 116, over which a table 106 provided with an elastic outer peripheral wall 105 is fitted. A bored doughnut-like gasket 104 having a through bore running along its axis is arranged around an opening formed through the top of the box body 113 and is rigidly held by a pair of bored keep plates 117, 118 arranged respectively on the upper and lower surfaces of the gasket 104.

Injection pipe 102 has a thinned pipe portion with a small diameter 107 running through the gasket 104 and projecting outward and upward from the inside of the valve box 101 and an enlarged lower pipe portion with a large diameter 108 having its bottom airtightly abutting elastic peripheral wall 105. The enlarged pipe portion 108 is provided at its lower end with notches 119 which are spaced apart from adjacent ones, while the thinned pipe portion 107 is provided on its side at an area that contacts with the gasket 104 with a communicating hole 110 and on the other surface at the middle of the area projecting from the outward and upward from the valve box with a large stopper 120. The injection pipe 102 is constantly urged upward by a pusher coil spring 109 arranged around the outer surface of the enlarged pipe portion 108 so that a small chamber 111 is formed between enlarged pipe portion 108 and the upper surface of said table 106 as long as the injection pipe 102 is biased upward. Communicating hole 110 is normally closed by the side wall of the gasket 104, although it comes to open for the valve box 101 when the gasket 104 is pushed down for injection of liquid.

As shown in FIG. 9, the injection button 103 is provided with a nozzle cap 121 which is realized in the form of a sidewise cap hold a nozzle 112 in the center of it and disposed in the injection button. A spin groove 122 is arranged behind the nozzle cap 121 in communication with the nozzle 112 and a peripheral groove 123 is arranged behind the spin groove 122 in communication therewith in such a manner that the lowest portion of the peripheral groove 123 connected with the upper portion of the injection pipe 102 by way of a liquid path 124, communicates with injection pipe 102.

Thus, when the injection button is depressed downward, the injection pipe 102 is brought downward with the injection button to open the communicating hole 110 for the valve 101 so that the liquid intake and pressure system located in the lower portion of the jet blower main body comes to be communicated with the injection button 103 by way of the valve box 101, the communicating hole 110 and the injection pipe 102 and consequently the pressurized liquid in the container is blown out of the nozzle 112 in fine particles. Once, however, the injection button 103 is released, the injection pipe 102 is pushed up by the pusher spring 109 to the normal position and a small chamber 111 is formed within the enlarged pipe portion 108 to attract a certain amount of the liquid remained in the container into the small chamber 111 and lower the level of the remaining liquid so much that the nozzle 112 may be free from clogging due to the liquid which is otherwise left at or near the nozzle 112.

Now, the liquid intake and pressure system in the jet blower main body will be described, although it may be configured in an appropriate manner. FIGS. 10 and 11 shows a manually operated system that can minimize the possibility of contaminating the atmosphere.

In FIGS. 10 and 11, reference numeral 125 denotes the container main body, 126 a cylinder screwed into the neck 127 of the container main body 125 and projecting downward into the upper portion in the inside of the container main body 125, 128 a suction valve arranged at the bottom of the cylinder 126, 129 a suction pipe suspending from the lower end of the cylinder 126 into the lower portion in the inside of the container main body 125, 130 a pipe suspending from the axial core of the cylinder 126 and having its upper end connected to connector pipe 114 in communication therewith, 131 a plunger tightly and slidably fitted to the inner surface of the cylinder 126, 132 a movable valve rigidly fitted to the lower end of the plunger 131 to shut off the inside of the cylinder 126 around the pipe 130 and to make the lower portion of the inside of the cylinder 126 into a pressure chamber A, 133 a sliding tube integrally formed with the plunger 131 and standing upright from the upper end of the plunger 131, 134 a rotary tube fitted to an engaging tube 136 standing from the top of cylinder 126 by means of a fitting peripheral wall 135 and vertically slidably fitted to sliding tube 133 and 137 a pusher spring to constantly urge the plunger downward. The aerosol type injection valve B as described earlier is built into the top of the rotary tube 134.

More specifically, a rotary head 138 is integrally formed with the injection valve B and projecting outward and downward from the top of the valve box 101. Rotary head 138 is arranged around the engaging tube 136 and rotatively fitted to the outer surface of its peripheral wall 135 and carries in it an inner tubular member 139 which is only longitudinally slidable relative to rotary tube 134. Thus, the rotary tube 134 and the sliding tube 133 can be rotated with the rotary head 138 by rotating the latter.

Sliding tube 133 and the engaging tube 136 constitute a cam mechanism 141 with balls 140 arranged therebetween. In other words, a zigzag cam groove 144 having inclined groove sections 142 and vertical groove sections 143 as illustrated in FIG. 11 is formed on the outer surface of the sliding tube 133, while a set of longitudinal grooves 145 are formed on the inner surface of the engaging tube 136 in such a manner that a half of each of the balls 140 is received in one of the grooves 145 and the other half of the ball is received in the cam groove 144. Reference numeral 146 denotes a cap.

With a jet blower provided with cam mechanism having a configuration as described above, the rotary head 138 is rotated in a given direction for jet blowing. As the rotary motion of the rotary head 138 is transmitted to the sliding tube 133 by way of the rotary tube 134, the rotary force is converted by the inclined groove sections 142 of the cam mechanism 141 into a force to push up the sliding tube 133 and the plunger 131 against the resilient force of the spring 137 trying to push down them. As the plunger 131 is pushed up, the pressure in the pressure chamber A becomes negative to open the suction valve 128 and attract the liquid in the container 125 into the pressure chamber A.

When the sliding tube 133 reaches its uppermost position along the inclined groove sections 142, the balls 140 are located on the vertical groove sections 143 of the cam groove 144 and the sliding tube 133 is pushed down by the spring 137 to increase the pressure applied to the liquid in the pressure chamber A so that the liquid remains under pressure in the chamber.

If, under this condition, the injection button 103 is depressed to open the injection valve 102, the liquid in the pressure chamber A is driven out from there under pressure, passes through the pipe 130, the valve box 101 and the injection pipe 102 and blown out in fine particles from the nozzle 112 of the injection button 103. As the liquid is ejected from the chamber, the plunger 131 is lowered by the resilient force of the coil spring 137 to constantly apply pressure to the liquid in the pressure chamber A so that the liquid will be driven out from there so long as the injection button 103 is kept depressed.

Since the above described embodiment is realized in the form of a handy jet blower having an aerosol type injection valve B and comprises an opening at the lower end of the injection pipe 102 of the injection valve B arranged in such a manner that a small chamber 111 that communicates with the opening is formed within the valve box 101 when the injection valve is returned to its normal position to attract any liquid remaining in the container into the small chamber 111 by way of the opening of the injection pipe 102 and consequently lower the level of the remaining liquid under the nozzle 112, the nozzle being completely free from clogging due to dried particles of the liquid.

Embodiment 3

Now a third embodiment of the invention will be described by referring to FIGS. 12 through 14.

Reference numeral 201 denotes a container, 202 a main tube from which a first cylinder 204 having a suction valve 203 is projecting downward. An upper tube 205 is standing upward from an outward flange arranged on the top of the cylinder. The main tube is also provided with a screwed tube 206 arranged on its outer surface of the upper tube and screwed to a neck portion of the container. Upper tube 205 is provided with a plurality of longitudinal grooves 207 arranged on its inner surface and regularly spaced apart from any adjacent ones.

Sliding tube 210 is vertically and slidably arranged within main tube 202. The lower half of the sliding tube is formed to be a tubular plunger 211, which is fitted to the inside of the first cylinder 204 and has a cam tube 213 standing from its top with an outward flange 212 arranged therebetween, cam tube 213 being fitted to the inside of the upper tube 205.

Cam tube 213 is provided with a continuous cam groove 216 having inclined groove sections 214 and vertical groove sections 215 which are alternatively arranged as illustrated in FIG. 14. A number of balls 217 are fitted into the cam groove 216, a half of each of the balls being received in the cam groove and the other half being received by a corresponding one of vertical grooves 207 so that, if the sliding tube 210 is rotated relative to the main tube 202, it is vertically reciprocated while it is being rotated. The cam tube is provided with a plurality of first vertical engaging grooves 218 and the tubular plunger 211 and the first cylinder 204 constitute a pressure chamber 219.

A tubular cap 220 is rotatively fitted to the outer surface of the upper tube 205. The tubular cap preferably comprises an inner tubular member **220*a* and an outer tubular member 220*b* as illustrated in FIG. 13. The inner tubular member comprises a first engaging tube 222 provided on its outer surface with first engaging ridges 221 that come to be vertically and slidably engaged with the respective first engaging grooves 221 and a second engaging tube 224 suspending from the outer periphery of the bored top 223 of first engaging tube 222 and rotatively fitted to the outer peripheral surface of the upper portion of the upper tube 205. First compression spring 225 is arranged between the lower surface of the inner periphery of the bored top and the outward flange of the sliding tube, a third engaging tube 227 being standing from the upper surface of the bored top and provided with second vertical engaging ridges 226** on its outer peripheral surface.

Outer tubular member **220*b* has an actuator receiving hole 228 at the center of its top wall and a peripheral wall 229 projecting outwardly and downwardly from the outer periphery of the top wall and rotatively fitted to the outer surface of the upper tube 205. Outer tubular member 220*b* further comprising a fourth engaging tube 230 suspending from the inside of the top of the peripheral wall 229 and having second engaging grooves 231 arranged on its inner peripheral surface, second engaging ridges 226 being engaged with the respective second engaging grooves 231 so that inner tubular member 220*a* can be rotated by rotating the outer tubular member 220*b*. Top wall 232 of the tubular cap is provided on its lower surface and at the inside of the fourth engaging tube 230 with a circular groove 233** that faces downward.

Circular groove 233 receives the top of a tubular member 240. Member 240 comprises a second cylinder 241 which is constituted by its upper portion and functions as a valve box and a tube 242 suspending from the inner periphery of its bored bottom which is realized in the form of an inward flange arranged at the bottom of the second cylinder and fitted into the tubular plunger 211 which is described earlier. The lower half of the tube 242 has a diameter smaller that of the upper half so that it airtightly contacts the inner surface of the tubular plunger by way of a plunger seal 281 in such a manner that the tubular plunger is vertically movable around the lower half.

The lower portion of actuator 245 is fitted into the second cylinder 241. Actuator comprises a stem 247 standing from the top of a third cylinder 246 with a shoulder therebetween and a pusher head 248 provided with a nozzle at the top and an inner tube 249, into which the top of the stem is fitted. The stem has a discharge valve hole 250 at the bottom. The outer diameter of inner tube 249 is such that it can vertically move through a through bore of the actuator.

A tubular valve 251 is fitted to the outer surface of the stem between the shoulder of actuator 245 and the lower end of inner tube 249 in such a manner that the actuator can be raised by pushing up the shoulder and lowered by pushing down the lower end of the inner tube 249 and that its outer peripheral surface is slidable on inner surface of the second cylinder 241. As illustrated in the left half of FIG. 12, tubular valve 251 is held between the shoulder and the lower surface of the top wall 232 of the outer tubular member **220*b* when the actuator 245 is raised. Discharge valve hole 250 is closed when the tubular valve is in contact with the upper surface of the shoulder of the actuator and opened when the tubular valve is moved away from the shoulder as illustrated in the left half of FIG. 12**.

The upper portion of tubular member 240 is designed to receive a rod 256 having a fluid conduit groove 255. Rod 256 comprises a piston 257 which is constituted by its upper portion and fitted into the third cylinder 246.

A second compression spring 258 is disposed between piston 257 and a stepped area arranged on the inner surface of the stem 247 and facing downward so that the actuator 245 is constantly urged upward.

With the third embodiment having a configuration as described above, since the third cylinder 246 continues to go up for some time after the discharge valve 250 is closed in order to bring the inside of the third cylinder under negative pressure, the liquid left in the nozzle, if any, is drawn back into the cylinder and consequently the nozzle is completely free from clogging that can be caused by dried liquid within the nozzle. Therefore, this embodiment is as effective as the second embodiment in terms of anti-clogging effects. Unlike the second embodiment, on the other hand, this embodiment has a tubular member 240 whose top is fitted into a circular groove 233 arranged on the lower surface of the top 232 of the tubular cap 220 so that the tube 242, projecting downward from the bottom of the inward flange of the second cylinder 241 which is formed by the upper portion of the tubular member and serves as a valve box, provides a communication route that connects the inside of the second cylinder and that of the pressure chamber 219. With such an arrangement and configuration of the tubular cap 220, it can be prepared with utmost ease. Moreover, since the piston 257 fitted into the third cylinder 246 is integrally formed with the rod 256 having a fluid conduit groove 255, it can be mounted to the entire assembly very easily.

Embodiment 4

Now a fourth embodiment of the invention will be described by referring to FIGS. 15 through 19.

Reference numeral 301 denotes a container, 302 a main tube from which a first cylinder 304 having a suction valve 303 is projecting downward. An upper tube 305 is standing upward from an outward flange 305*a* arranged on the top of the cylinder. Main tube 302 is also provided with a screwed tube 306 arranged on an outer surface of the upper tube and screwed to a neck portion of the container. Upper tube 305 is provided with a plurality of longitudinal grooves 307 arranged on its inner surface and regularly spaced apart from any adjacent ones.

A sliding tube 310 is vertically and slidably arranged within 310 main tube 302. The lower half of sliding tube 310 is formed to be a tubular plunger 311, which is fitted to the inside of the first cylinder 304 and has a cam tube 313 standing from its top with an outward flange 312 arranged therebetween, cam tube 313 being fitted to the inside of the upper tube 305. Cam tube 313 is provided with a continuous cam groove 316 having inclined groove sections 314 and vertical groove sections 315 which are alternatively arranged as illustrated in FIG. 17. A number of balls 317 are fitted into the cam groove 316, a half of each of the balls being received in the cam groove and the other half being received by a corresponding one of vertical grooves 307 so that, if the sliding tube 310 is rotated relative to the main tube 302, it is vertically reciprocated while it is being rotated. The cam tube is provided with a plurality of first vertical engaging grooves 318. Tubular plunger 311 and the first cylinder 304 constitute a pressure chamber 319.

A tubular cap 320 is rotatively fitted to the outer surface of the upper tube 305. Tubular cap preferably comprises an inner tubular member 320*a* and an outer tubular member 320*b*. The inner tubular member comprises a first engaging tube 322 provided on its outer surface with first engaging ridges 321 that come to be vertically and slidably engaged with the respective first engaging grooves 321 and a second engaging tube 324 suspending from the outer periphery of a bored top 323 of the first engaging tube and rotatively fitted to the outer peripheral surface of the upper portion of the upper tube 305, a first compression spring being arranged between the lower surface of the inner periphery of bored top 323 and outward flange 312 of the sliding tube, a third engaging tube 327 standing from the upper surface of bored top 323 and being provided with second vertical engaging ridges 326 on its outer peripheral surface.

Outer tubular member 320*b* has an actuator receiving hole 328 at the center of its top wall and a peripheral wall 329 projecting outwardly and downwardly from the outer periphery of the top wall and rotatively fitted to the outer surface of the upper tube 305, the outer tubular member 320*b* further comprising a fourth engaging tube 330 suspending from the inside of the top of the peripheral wall 329 and having second engaging grooves 331 arranged on its inner peripheral surface, second engaging ridges 326 being engaged with the respective second engaging grooves 331 so that inner tubular member 320*a* can be rotated by rotating the outer tubular member 320*b*. A top wall 332 of the tubular cap is provided on its lower surface and at the inside of fourth engaging tube 330 with a circular groove 333 that faces downward.

Circular groove 333 receives the top of a tubular member 340. Member 340 comprises a second cylinder 341 which is constituted by its upper portion and functions as a valve box and a tube 342 suspending from the inner periphery of its bored bottom which is realized in the form of an inward flange arranged at the bottom of the second cylinder and fitted into the tubular plunger 311 which is described earlier. The lower half of the tube 342 has a diameter smaller that of the upper half so that it airtightly contacts the inner surface of the tubular plunger by way of a plunger seal 381 in such a manner that the tubular plunger is vertically movable around the lower half.

The lower portion of actuator 345 is fitted into the second cylinder 341. Actuator 345 comprises a stem 347 standing from the top of a third cylinder 346 with a shoulder therebetween and a pusher head 348 provided with a nozzle at the top and an inner tube 349, into which the top of the stem is fitted. The stem has a discharge valve hole 350 at the bottom. The outer diameter of inner tube 349 is such that it can vertically move through a through bore of the actuator.

A tubular valve 351 is fitted to the outer surface of the stem between the shoulder of actuator 345 and the lower end of inner tube 349 in such a manner that the actuator can be raised by pushing up the shoulder and lowered by pushing down the lower end of the inner tube 349 and that its outer peripheral surface is slidable on the inner surface of the second cylinder 341. Tubular valve 351 is held between the shoulder and the lower surface of top wall 332 of outer tubular member 320*b* when the actuator 345 is raised. Discharge valve hole 350 is closed when the tubular valve is in contact with the upper surface of the shoulder of the actuator and opened when the tubular valve is moved away from the shoulder as illustrated in the left half of FIG. 15.

The upper portion of tubular member 340 is designed to receive a rod 356 having a fluid conduit groove 355. Rod 356 comprises a piston 357 which is constituted by its upper portion and fitted into the third cylinder 346.

A second compression spring 358 is disposed between piston 357 and a stepped area arranged on the inner surface of a stem 347 and facing downward so that the actuator 345 is constantly urged upward.

In this embodiment, first cylinder 304 and the outward flange 305*a* are connected with each other by means of a plurality of connector plates 360 standing outwardly from the outer surface of the upper portion of the cylinder and spaced apart from any adjacent ones. The cylinder is provided at its top portion with an axial groove 361.

Elastic tube section 363 of valve tube 362 is projecting downward into the space between the upper portion of the cylinder and the connector plates 360 and the inner periphery of the bottom of the elastic tube section is tightly fitted to the outer peripheral wall of the cylinder located below the connector plates to form an ambient air inlet valve 364 that also takes the role of relieving the remaining inside pressure. Elastic tube section 363 is suspending from a bored disc 365 of the valve tube 362 and the outer periphery of the bored disc is rigidly fitted to the upper surface of the outward flange 305*a*. The outer periphery of the bored disc may be rigidly fitted to the upper surface of the outward flange by placing the outer periphery of a holder ring 366 to the bottoms of the vertical ridges arranged on the inner periphery of the lower portion of the upper tube 305 in such a manner that the bored disc 365 is held between the holder ring and the outward flange 305*a* as seen from FIG. 15.

When the sliding tube 310 is located at its uppermost position as illustrated in FIG. 16, ambient air can enter the inside of the container 301 by way of a recess 367 formed on the outer periphery of the tubular plunger 311 which is in contact with the inner periphery of the bored disc 365 so that the outer periphery may be released from the inner periphery of the bored disc as well as the space between the inner surface of the upper tube 305 and the outer surface of the sliding tube located above the tube valve 362.

It should be noted that a circular groove 368 is formed on the outer periphery of the upper portion of the tubular plunger 311 and a side groove is further formed in the bottom of the groove so that the inner peripheral area of a packing 369 is received in groove 368 and its outer peripheral area is slidably in contact with the inner surface of the upper tube. Thus, any shock that may be given rise to when the sliding tube 310 falls down without any liquid contained in the container can be absorbed by packing 369 and a short tube 370 standing upward from the upper surface of bored disc 365.

Since the embodiment has a configuration as described above, where the inner periphery of the lower end of the elastic tube section 363 is closely in contact with the outer peripheral surface of the cylinder to form an ambient air inlet valve 364 that also plays the role of a pressure relief valve and an axial groove 361 is formed on the upper portion of the cylinder above the contact area of the elastic tube section to replace a through bore of any of the other embodiments, any pressure remaining in the pressure chamber can be relieved by outwardly pushing and expanding the elastic tube section 363 which downwardly projecting from the valve tube and consequently any pressure as well as any liquid remaining in the container can be ejected out of it outwardly and downwardly. Therefore, unlike the case where the remaining pressure is relieved horizontally, no liquid will attach the inside of the upper portion of the container of this embodiment and give the user an unpleasant and uneasy feeling. When the tubular plunger 311 is at its uppermost position and the pressure within the container turns negative, ambient air enters the container via the ambient air inlet valve 364 via the groove 368 formed on the tubular plunger 311 in the area that contacts the inner periphery of the bored disc 365 to release the plunger from the bored disc which are in contact with each other under an airtight condition. With such an arrangement, the overall configuration of the embodiment can be considerably simple because the ambient air inlet valve 364 also plays the role of a pressure relief valve. Moreover, since the lower end of the elastic tube section is normally in close contact with the outer peripheral surface of the cylinder to airtightly seal the container, no liquid will flow out of the container passing through the ambient air inlet valve even if the container falls down when ambient air is entering the pressure chamber and therefore the sliding tube is located at its uppermost position.

The discharge valve (V) of any of the above described embodiment can be replaced by either one of the valves illustrated in FIGS. 18 and 19.

The discharge valve (V) has a bottomed valve tube 417 fitted into the lower end of the depressing spraying head 409. An annular concave part is provided on the side of the middle portion of valve tube 417 and a valve hole 418 is drilled in this annular concave part. A collar-like elastic body 419 having a first through-hole is located at the upper end of stem 406, a casing 420 having a second through-hole is fitted onto the upper portion of the stem 406 and the elastic member 419 is secured thereto. The valve tube 417 is inserted through the second through-hole of the casing 420 and the second hole of the elastic member 419 into the stem 406, the elastic member 419 is fitted into the annular concave part of the valve tube and valve hole 418 is sealed by means of the inner peripheral surface of the elastic body 419. In addition, the bottomed valve tube 417 is urged upwards by means of spring 414, thereby maintaining the valve-sealing condition of the elastic member 419 and, together with the lowered depressing spraying head 9, as better illustrated in FIG. 4, the bottomed valve tube 417 is lowered, thereby opening the valve hole 418. In the illustrated example, the elastic member is deformed when the valve is opened, but an elastic member for opening the valve by sliding may be also used. A discharge valve (V) as illustrated in FIG. 8 or a discharged valve (V) as illustrated in FIG. 12 may be used for the fourth embodiment. Similarly, the discharge valve of FIG. 12 may be replaced by the discharge valve of FIG. 8.

INDUSTRIAL APPLICABILITY

This invention can be applied not only to a spray-type blower, but also to a jet blower that discharges its content in the form of liquid or foam without reducing it into fine particles.

The liquid jet blower of this invention can be used for, e.g., perfume, detergent or pesticide.

What is claimed is:

1. A liquid jet blower comprising a container, a cylinder projecting downward in said container, a pressure vessel in the form of a tubular plunger fitted within said cylinder and urged downward for suctioning the liquid in the container, said cylinder being constituted by a lower portion of a main tube arranged on said container, an outer tube arranged around and engaged with an upper tube which is an upper portion of said main tube, a cam mechanism capable of rotatively raising and lowering an actuator tube provided with said tubular plunger by rotating said outer tube relative to said main tube, a valve assembly having a valve box fitted to the inner surface of said upper tube, a discharge pipe projecting downward from said valve box into a pressure chamber in the cylinder through an airtight bore arranged in said tubular plunger and a head standing from said valve box, the liquid in said pressure chamber being discharged in a jet stream from a nozzle of the head as the head is pushed downward to open a discharge valve arranged in the valve box, characterized in that a through bore is formed through the top of said cylinder, an elastic valve plate being arranged on the top of the cylinder as an anti-negative pressure valve to resiliently close the through bore, a first groove and one sealing ridge being formed respectively on the inner peripheral surface on said cylinder near the lower end thereof and on the outer peripheral surface of said tubular plunger near the lower end thereof to airtightly seal the space between the cylinder and the plunger so that any excessive pressure in the pressure chamber may be relieved out of the container through the space between the inner peripheral surface of the tubular plunger and the anti-negative pressure valve when said one sealing ridge is received in the first groove.

2. A liquid jet blower according to claim 1, wherein another sealing ridge is formed on the inner peripheral surface of the lower end of the upper tube above the through bore to airtightly contact with the outer surface of the tubular plunger, and a second groove is formed on the outer peripheral surface of the tubular plunger near the lower end thereof, so that ambient air may flow into the container through the second groove and the anti-negative pressure valve when the tubular plunger is brought to its uppermost position, said another sealing ridge being a first sealing ridge and said one sealing ridge being a second sealing ridge.

3. A liquid jet blower according to claim 1, characterized in that it additionally comprises a third groove formed on the outer peripheral surface of the tubular plunger near the upper end thereof and a bored elastic disc arranged around said third groove with its inner periphery fitted into said third groove and its outer periphery abutting the inner peripheral surface of the upper tube, the air contained in the space defined by said bored elastic disc, the inner surface of the upper tube below said bored elastic disc and the outer surface of the tubular plunger functioning as an air cushion having an air outlet when the tubular plunger is urged downward.

4. A liquid jet blower according to claim 1, characterized in that said outer tube is constituted by an inner tubular member comprising first and second engaging tubes and projecting downward respectively from the outer periphery and the inner periphery of the bored top of the inner tubular member and an outer tubular member having a lower tubular portion fitted to the outer surface of said inner tubular member, a second flange formed on the inner peripheral wall of said first engaging tube near the lower end thereof and rotatively abutting the lower surface of a first flange formed on the outer peripheral surface of the upper tube near the upper end thereof and a second group of longitudinal grooves and ridges being formed on the outer peripheral surface of the second engaging tube, said second longitudinal grooves and ridges being engaged with a first group of longitudinal grooves and ridges formed on the inner peripheral surface of a cam cylinder standing upward from the top of the tubular plunger so that said second engaging cylinder and said cam cylinder may be longitudinally slidable relative to each other.

* * * * *

UNITED STATES PATENT AND TRADEMARK OFFICE

CERTIFICATE OF CORRECTION

PATENT NO. : 5,240,153
DATED : August 31, 1993
INVENTOR(S) : Tatsuo Tubaki, et. al.

It is certified that error appears in the above-indentified patent and that said Letters Patent is hereby corrected as shown below:

On the Title page, item [22],

Change "[22] Filed: August 1, 1991" to
--[22] PCT Filed: Dec. 21, 1990--.

Insert --[86] PCT No.: PCT/JP90/01677--
§371 Date: Aug. 1, 1991
§102(e) Date: Aug. 1, 1991--.

Insert --[87] PCT Pub. No.: WO91/09683
PCT Pub. Date: July 11, 1991--.

Signed and Sealed this
Fifth Day of April, 1994

Bruce Lehman

*Attest:*

BRUCE LEHMAN

*Attesting Officer*

*Commissioner of Patents and Trademarks*